US006148458A

United States Patent [19]

Hires

[11] Patent Number: 6,148,458

[45] Date of Patent: Nov. 21, 2000

[54] BEDDING SYSTEM WITH A LOWER SHEET HAVING TRANSVERSE POCKETS

[76] Inventor: James D. Hires, 125 37th St., South, St. Petersburg, Fla. 33711

[21] Appl. No.: 09/437,115

[22] Filed: Nov. 10, 1999

[51] Int. Cl.[7] ..... A47G 9/02

[52] U.S. Cl. ..... 5/485; 5/662

[58] Field of Search ..... 5/482, 485, 486, 5/494, 499, 500, 662

[56] References Cited

U.S. PATENT DOCUMENTS

| | | | |
|---|---|---|---|
| 1,201,157 | 10/1916 | Dawes | 5/662 X |
| 4,021,869 | 5/1977 | Root | 5/485 X |
| 4,903,360 | 2/1990 | Friedman | 5/494 X |
| 5,791,000 | 8/1998 | Noyes | 5/662 X |

*Primary Examiner*—Michael F. Trettel

[57] ABSTRACT

A sheet which comprises sheet material in an essentially rectangular configuration with a head end, a foot end, and parallel side edges therebetween and a transverse center line positioned over the transverse center line of the mattress. A first transverse fold line is located at a predetermined orientation with respect to the transverse center line. A second transverse fold is located at a predetermined distance from the first fold whereby the sheet material between the two folds is parallel with and overlies a portion of the sheet therebeneath thereby forming a pocket with its opening facing the head end. Stitching extends through the material of the pockets to maintain the pockets in a predetermined orientation.

6 Claims, 2 Drawing Sheets

FIG 1
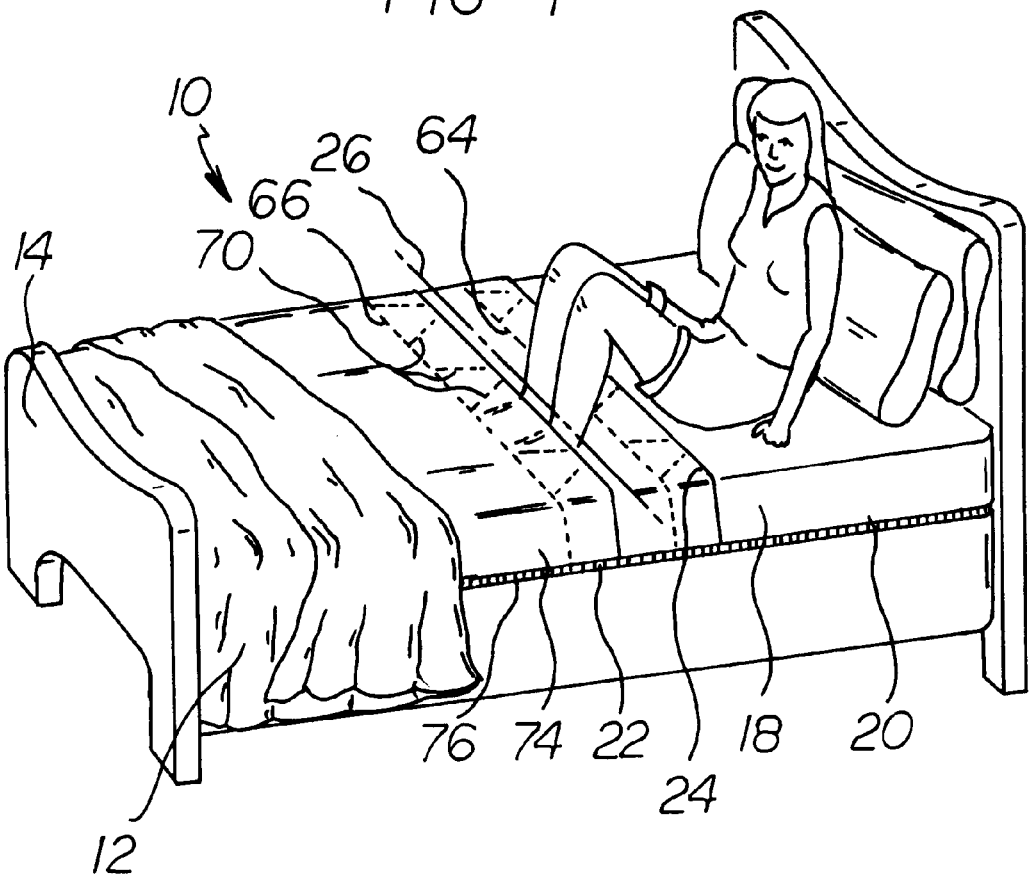
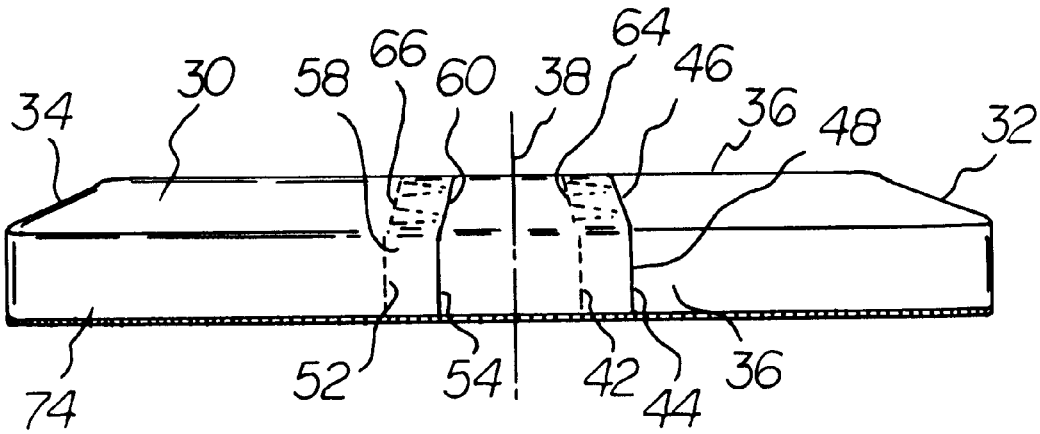
FIG 2

BEDDING SYSTEM WITH A LOWER SHEET HAVING TRANSVERSE POCKETS

BACKGROUND OF THE INVENTION

1. Field of the Invention

The present invention relates to a bedding system with a lower sheet having transverse pockets and, more particularly, pertains to supporting a user's toes and feet for more readily holding his or her legs in a vertically bent position.

2. Description of the Prior Art

The use of foot and leg holders of a wide variety of designs and configurations is known in the prior art. More specifically, foot and leg holders of a wide variety of designs and configurations heretofore devised and utilized for the purpose of holding a user's feet and legs in a predetermined orientation through a wide variety of methods and apparatus are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,627,123 to Uggerud a bed tick with pocket for user's feet adapted to receive the feet of a user sleeping or resting in a bed, to protect the feet against cold and draft.

U.S. Pat. No. 4,765,005 to Hippel discloses an adjustable foot support system easily attachable to a bed or other personal support, for aiding persons in maintaining a sitting position while in bed on a mattress surface or other personal support.

Lastly, U.S. Pat. No. 5,153,959 to Fitzsimmons discloses an apparatus and process for the movement of a patient within a hospital bed. A strap is utilized in the process having a first portion for fastening to the head of the bed and a second portion for defining a foot hold for the patient.

In this respect, the bedding system with a lower sheet having transverse pockets according to the present invention substantially departs from the conventional concepts and designs of the prior art, and in so doing provides an apparatus primarily developed for the purpose of supporting a user's toes and feet for more readily holding his or her legs in a vertically bent position.

Therefore, it can be appreciated that there exists a continuing need for a new and improved bedding system with a lower sheet having transverse pockets which can be used for supporting a user's toes and feet for more readily holding his or her legs in a vertically bent position. In this regard, the present invention substantially fulfills this need.

SUMMARY OF THE INVENTION

In view of the foregoing disadvantages inherent in the known types of foot and leg holders of a wide variety of designs and configurations now present in the prior art, the present invention provides an improved bedding system with a lower sheet having transverse pockets. As such, the general purpose of the present invention, which will be described subsequently in greater detail, is to provide a new and improved bedding system with a lower sheet having transverse pockets and method which has all the advantages of the prior art and none of the disadvantages.

To attain this, the present invention essentially comprises a new and improved bedding system with a lower sheet having transverse pockets for supporting a user's toes and feet for more readily holding his or legs in a vertically folded orientation comprising, in combination, a bed having a frame in a rectangular configuration with an upper horizontal support surface; a mattress in a generally rectangular configuration with side faces, a lower surface positionable upon the upper surface of the frame and an upper surface with a transverse center line; a sheet of flexible fabric in an essentially rectangular configuration with a head end, a foot end, and parallel side edges therebetween and a transverse center line positioned over the transverse center line of the mattress; a first fold line in the sheet about six inches from the center line on the side thereof closer to the head end; a second transverse fold line between about three and five inches from the first center line whereby the sheet material between the first and second fold lines is parallel with and overlying a portion of the sheet thereby forming a pocket with its opening facing the head end; a third transverse fold line about six inches from the center line of the side thereof closer to the foot end; a fourth transverse fold line between about three and five inches from the third fold line whereby the sheet material between the third and fourth fold lines is parallel with and overlies a portion of the sheet thereby forming a second pocket with its opening facing the head end; a plurality of lines of stitching through the three layers of materials forming each pocket for maintaining the pockets in their proper orientation, the lines of stitching being offset from parallel with the side edges of the sheet; and downwardly turned sides on the sheets extending downwardly over the sides of the mattress and inwardly turned therebeneath with elastic at the peripheral edges of the sheet to maintain the sheet in position on the mattress.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bedding system with a lower sheet having transverse pockets which has all the advantages of the prior art foot and leg holders of a wide variety of designs and configurations and none of the disadvantages.

It is another object of the present invention to provide a new and improved bedding system with a lower sheet having transverse pockets which may be easily and efficiently manufactured and marketed.

It is a further object of the present invention to provide a new and improved bedding system with a lower sheet having transverse pockets which is of a durable and reliable construction.

An even further object of the present invention is to provide a new and improved bedding system with a lower sheet having transverse pockets which is susceptible of a low cost of manufacture with regard to both materials and labor, and which accordingly is then susceptible of low prices of sale to the consuming public, thereby making such foot and leg holders of a wide variety of designs and configurations economically available to the buying public.

Still yet another object of the present invention is to provide a new and improved bedding system with a lower sheet having transverse pockets which provides in the apparatuses and methods of the prior art some of the advantages thereof, while simultaneously overcoming some of the disadvantages normally associated therewith.

Even still another object of the present invention is to support a user's toes and feet for more readily holding his or her legs in a vertically bent position.

Lastly, it is an object of the present invention to provide a sheet comprising sheet material in an essentially rectangular configuration with a head end, a foot end, and parallel side edges therebetween and a transverse center line positioned over the transverse center line of the mattress; a first transverse fold line at a predetermined orientation with respect to the transverse center line; a second transverse fold at a predetermined distance from the first fold whereby the sheet material between the two folds is parallel with and overlies a portion of the sheet therebeneath thereby forming a pocket with its opening facing the head end; and stitching extending through the material of the pockets to maintain the pockets in a predetermined orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the new and improved bedding system with a lower sheet having transverse pockets constructed in accordance with the principles of the present invention.

FIG. 2 is an enlarged perspective view similar to FIG. 1.

The same reference numerals refer to the same parts throughout the various Figures.

DESCRIPTION OF THE PREFERRED EMBODIMENT

Figure 3:
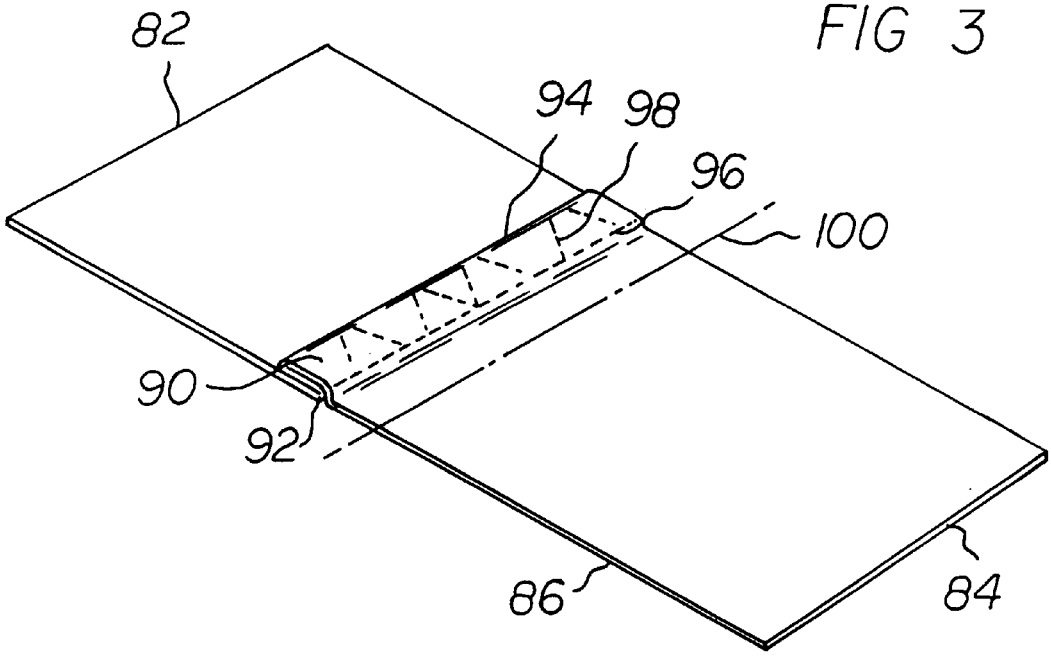
FIG. 3 is a perspective view of a sheet constructed in accordance with an alternate embodiment of the invention.

With reference now to the drawings, and in particular to FIG. 1 thereof, the preferred embodiment of the new and improved bedding system with a lower sheet having transverse pockets embodying the principles and concepts of the present invention and generally designated by the reference numeral 10 will be described.

The bedsheet system 10 of the present invention, which is designed to support a user's toes and feet for more readily holding his or her legs in a vertically oriented position, is comprised of a plurality of component elements. Such components in their broadest context include the bed, frame, mattress, sheet, first and second and optionally third and fourth fold lines to form one or more pockets with a plurality of rows of stitching and downturned sides.

More specifically, as shown in FIG. 1 there is a preferred embodiment of the new and improved bedding system with a lower sheet having transverse pockets constructed in accordance with the principles of the present invention. Such FIG. 1 illustration includes the bedding system 10 including a bed 12. The bed has a frame 14 in a rectangular configuration. The frame includes an upper support surface 14.

Positioned on the bed is a mattress 18. The mattress is also of a rectangular configuration having a peripheral edge 20 essentially the same as the peripheral edge of the frame. The mattress also has rectangular side faces 20 in a vertical orientation. It also includes a lower surface 22 positionable on the frame. It also includes an upper surface 24 with a transverse center line 26.

Next provided is a sheet 30. The sheet is fabricated of a flexible fabric material in an essentially rectangular configuration. It has a head end 32 and a foot end 34. The sheet also has parallel side edges 36 therebetween. The sheet also has a transverse center line 38 which, during operation and use, overlies the center line of the mattress.

Formed in the sheet is a first transverse fold line 42. Such fold line is located about six inches, plus or minus ten percent, from the center line of the sheet on the side thereof closer to the head end. In association with the first transverse fold line is a second transverse fold line 44. Such fold line is between about three and five inches from the first fold line. In this manner, the sheet material between the two folds is parallel with and overlies a portion of the sheet therebeneath. This thereby forms a pocket 46 with its opening 48 facing the head end.

Next provided are a third fold line 52 and a fourth fold line 54. The third fold line is located about six inches, plus or minus ten percent, from the center line of the sheet. It is located on the side of the center line closer to the foot end.

The fourth fold line is located between about three and five inches from the third fold line. In this manner, the sheet material between the two folds is parallel with and overlies a portion of the sheet remote from the portion of the sheet beneath the first pocket. Such third and fourth fold lines thereby form a pocket 58 with its opening 60 facing the head end.

Next provided are a plurality of rows of stitching. The stitching preferably includes a central line 64 for each pocket extending parallel with the side edges with the first line of stitching 66 extending through the three layers of material forming the first pocket. The second central row of stitching 68 extends centrally through the material axially aligned with the first row of stitching and couples the three rows of materials forming the second pocket. Additional angularly disposed rows of stitching 70 are formed in the first and second pocket extending through the three rows of fabric forming the respective pockets. Such supplemental rows of stitching are preferably at an angle offset slightly from parallel with the parallel side edges.

In the preferred embodiment, as shown in FIGS. 1 and 2, there are downwardly turned sides 74 of the sheet. Such sides extend downwardly over the sides of the mattress. They are then tucked inwardly beneath the mattress. Thereafter they are stitched in such position with a strip of elastic 76 at the peripheral edges of the sheet. In this manner a fitted sheet is formed to be positioned over a mattress top and sides and a portion of the lower surface to function as a bottom sheet.

Figure 4:
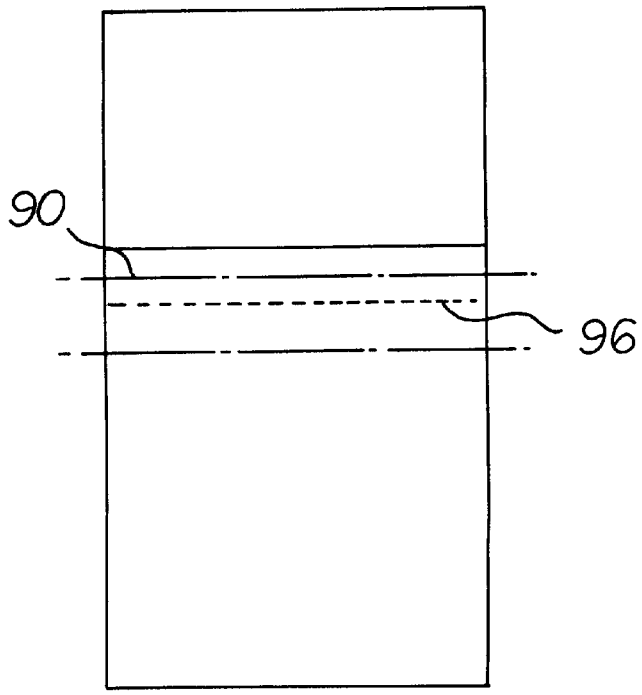
FIG. 4 is a plan view of the sheet shown in FIG. 3.

In the embodiment shown in FIGS. 3 and 4, the sheet 80 is formed in a rectangular configuration with a head end 82 and a foot end 84 and parallel side edges 86. It is totally rectangular with the downturned sides and elastic constituting the fitted sheet of the primary embodiment. In the alternate embodiment, the sheet is adapted to function as a lower sheet with its peripheral edges tucked under the mattress upon which it is located.

In addition, a single pocket 90 is formed with a first fold line 92 and a second fold line 94 interrelated in the manner as in the first embodiment. A central row of stitching 96 and additional angled rows of stitching 98 are also provided to extend through the three layers of material forming the pocket. The pocket may be at any predetermined orientation transverse of the sheet parallel with the head end and foot end and transverse to the side edges. It may be located at the center line 100 of the sheet or at any orientation slightly above or slightly below. A wide variety of variations are available in the sheet. It may be fabricated of natural materials such as cotton or silk, or synthetic materials such as nylon, orlon or any of the more conventional fabric materials. It may be fabricated preferably in white but in any of a wide variety of colors including patterns. In addition, any number of pockets may be utilized as a function of the desired positioning.

The present invention explores the perspective of mankind's uniqueness in bed and creates and achieves a new experience for comfort and pleasure. In order to receive maximum effect from the use of this product there will need to be two sections, a high and low section or a middle and low section.

The sections will contain pockets for one's feet in order to obtain better leverage associated with certain bedtime activities. One can slip his or her feet into pockets for comfort when one's knees are in an upright position. They will remain in that position until they are removed from the pockets. The pleat/pocket will be attached to the sheet on each side. In order to make the pleat/pocket more stable and secure there will need to be two or four seams depending on the size of the sheet. Dimensions will be arranged according to the size of the sheets, whether king, queen, standard or twin.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bedding system with a lower sheet having transverse pockets for supporting a user's toes and feet for more readily holding his or legs in a vertically folded orientation comprising, in combination:

a bed having a frame in a rectangular configuration with an upper horizontal support surface;

a mattress in a generally rectangular configuration with side faces, a lower surface positionable upon the upper surface of the frame and an upper surface with a transverse center line;

a sheet of flexible fabric in an essentially rectangular configuration with a head end, a foot end, and parallel side edges therebetween and a transverse center line positioned over the transverse center line of the mattress;

a first fold line in the sheet about six inches from the center line on the side thereof closer to the head end;

a second transverse fold line between about three and five inches from the first center line whereby the sheet material between the first and second fold lines is parallel with and overlying a portion of the sheet thereby forming a pocket with its opening facing the head end;

a third transverse fold line about six inches from the center line of the side thereof closer to the foot end;

a fourth transverse fold line between about three and five inches from the third fold line whereby the sheet material between the third and fourth fold lines is parallel with and overlies a portion of the sheet thereby forming a second pocket with its opening facing the head end;

a plurality of lines of stitching through the three layers of materials forming each pocket for maintaining the pockets in their proper orientation, the lines of stitching being offset from parallel with the side edges of the sheet; and downwardly turned sides on the sheets extending downwardly over the sides of the mattress and inwardly turned therebeneath with elastic at the peripheral edges of the sheet to maintain the sheet in position on the mattress.

2. A sheet comprising:

sheet material in an essentially rectangular configuration with a head end, a foot end, and parallel side edges therebetween and a transverse center line positionable over the transverse center line of the mattress, the sheet material having an upper surface to receive a Person thereon and a lower surface positionable on a mattress;

a first transverse fold at a predetermined orientation with respect to the transverse center line;

a second transverse fold at a predetermined distance form the first fold whereby the sheet material between the two folds is parallel with and overlies a portion of the sheet there beneath thereby forming a pocket with its opening facing the head end and adapted to receive and support the feet of a person on the sheet material; and stitching extending through the material of the pocket in a predetermined orientation, the stitching including Pluralities of rows of stitching across the sheet material from side edge to side edge to thereby retain the folds in the sheet material during use.

3. The sheet as set forth in claim 2 and further including a second pocket extending transversely of the sheet spaced from the first pocket a predetermined distance from the head end and the foot end.

4. The sheet as set forth in claim 2 wherein the sheet material includes downwardly turned sides of the sheet extendable over the side of a mattress and therebeneath with elastic at the peripheral edges of the sheet.

5. The sheet as set forth in claim 2 wherein the sheet material is totally planar and positionable on a mattress as an undersheet.

6. The sheet as set forth in claim 2 wherein the stitching is offset from parallel with the side edges of the sheet.

* * * * *